United States Patent [19]

Fallon et al.

[11] 4,165,870

[45] Aug. 28, 1979

[54] WAVE GENERATOR TO SHINGLE SHEETS

[75] Inventors: John L. Fallon, Longmont; Ernest P. Kollar, Weld County; Fred R. Mares, Boulder, all of Colo.

[73] Assignee: International Business Machines Corporation, Armonk, N.Y.

[21] Appl. No.: 888,096

[22] Filed: Mar. 20, 1978

[51] Int. Cl.[2] ..... B65H 3/06; B65H 3/32

[52] U.S. Cl. ..... 271/10; 271/22; 271/113; 271/120; 271/250

[58] Field of Search ..... 271/21, 22, 23, 24, 271/25, 19, 20, 113, 120, 119, 251, 250, 37, DIG. 9, 16, 17, 18, 10, 38; 198/782

[56] References Cited

U.S. PATENT DOCUMENTS

| | | | |
|---|---|---|---|
| 3,008,709 | 11/1961 | Buslik | 271/10 |
| 3,276,770 | 10/1966 | Griswold | 271/10 |
| 3,970,299 | 7/1976 | Berger et al. | 271/250 |
| 3,989,237 | 11/1976 | Goff et al. | 271/19 |

OTHER PUBLICATIONS

Hunt, R. E., "Paper Feed Wheel", *IBM Technical Disclosure Bulletin*, vol. 20, No. 8, Jan. 1978, p. 2933.

*Primary Examiner*—Bruce H. Stoner, Jr.
*Attorney, Agent, or Firm*—Francis A. Sirr

[57] ABSTRACT

An improved apparatus for successively separating and feeding sheets from a stack of sheets is disclosed. A wave generator wheel, rotating in a plane generally parallel to the stack, and about a tiltable axis generally perpendicular to the stack, is tiltable in a first direction to contact the stack for shingling the stack, and in a second direction to contact the stack for restoring the stack to its unshingled state. Sheets in a stack are driven forward or rearward by simply tilting the rotating wheel. The wave generator wheel is used to first drive the stack's top sheet away from a feed nip, and to then drive the stack's top sheet into the feed nip.

19 Claims, 15 Drawing Figures

WAVE GENERATOR TO SHINGLE SHEETS

BACKGROUND OF THE INVENTION

1. Field of the Invention

This invention relates to separating and feeding sheets from the top of a stack of such sheets. More specifically, it relates to improved apparatus for reliably separating and feeding single sheets only.

2. Description of the Prior Art

A wave generator (sometimes referred to as a combing wheel) rotating in a plane parallel to the stack from which sheets are to be fed is disclosed in U.S. Pat. No. 3,008,709 to Buslik. In Buslik's apparatus, a disk having free rolling means mounted thereon is raised and lowered into contact with the stack. All rollers either contact or are off the stack. The disk is fixedly attached to a rotating shaft which is raised and lowered in a direction generally perpendicular to the stack by means of a spring and solenoid. When the rotating disk with its free rolling balls is brought in contact with the stack, sheets are shingled or separated in a fan-like manner until the topmost sheet is in a position for further feeding.

OBJECTS OF THE INVENTION

It is an object of the present invention to reliably separate and feed one sheet at a time from a stack of such sheets in an improved manner.

It is another object of the invention to provide an improved reverse buckle sheet feed assembly.

SUMMARY OF THE INVENTION

These and other objects are accomplished through apparatus including a continuously rotating disk with free rollers attached to its periphery. This rotating disk is tiltable in at least two directions for imparting linear motion to sheets in a stack, for selectively feeding the sheets toward and away from a feed nip.

In one embodiment, a reverse buckle sheet feeding assembly includes the inventive wave generator, actuating means therefor, a buckle height sensor, and sheet drive means for grasping the top sheet for entrance to a feed path, and a circuit for controlling operation of the assembly.

The structure and manner of operation of the inventive wave generator means offer advantages not found in the prior art. The wave generator is a disk carrying free rolling means about its periphery. The disk can assume at least two tilted positions for bringing the free rolling means into contact with the stack, to thus effect sheet shingling in opposite directions. In combination with specially adapted stack restraining means, sheet position sensors and sheet feed means, the wave generator disk is controlled to cooperate therewith to provide reliable feed of but one sheet at a time. Our inventive apparatus minimizes the possibility of multiple sheet feeds, and thereby enhances high speed operation.

The foregoing and other objects, features and advantages of the invention will be apparent from the following more particular description of preferred embodiments of the invention, as illustrated in the accompanying drawing.

DETAILED DESCRIPTION

Figure 1:
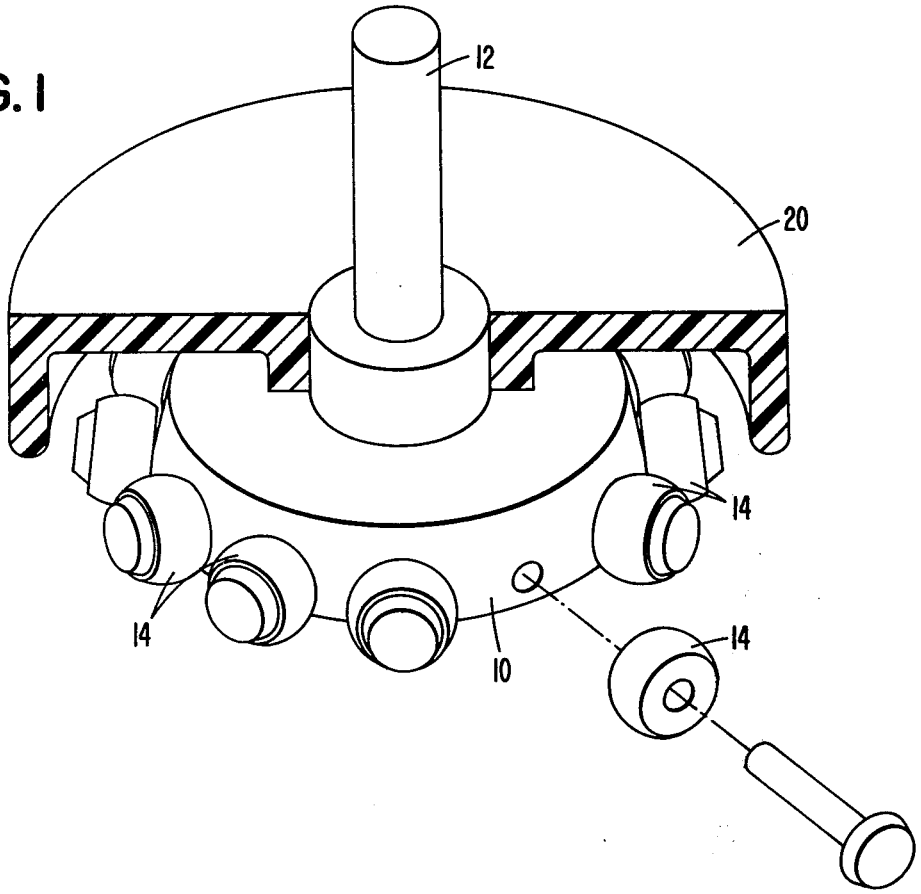
FIG. 1 shows the wave generator-wheel sheet separator of the present invention.
Figure 2:
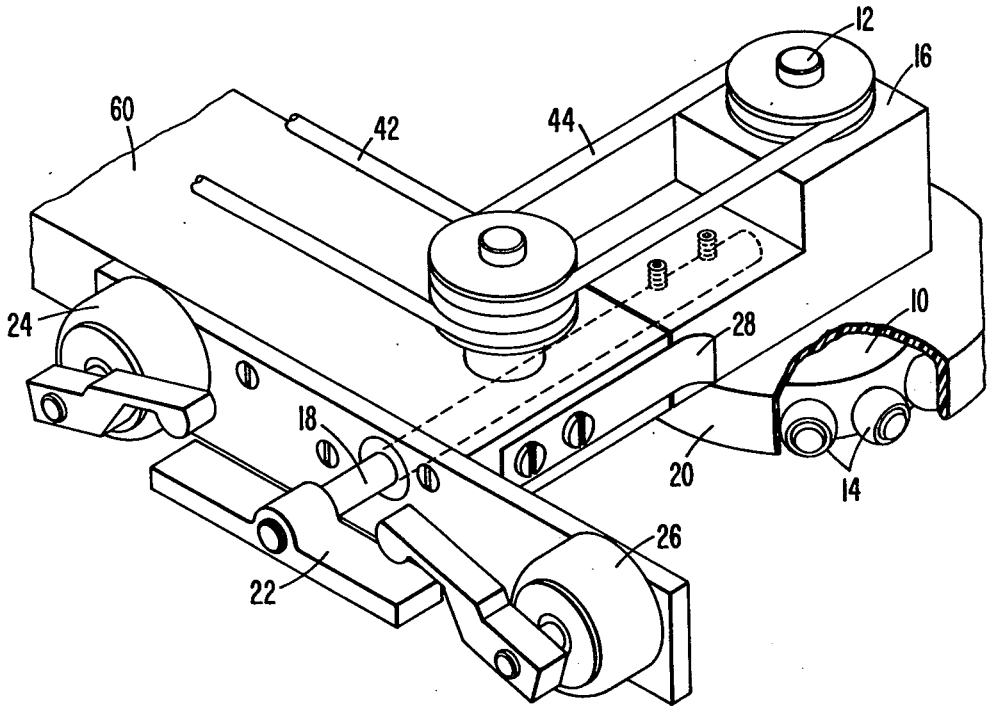
FIG. 2 is a partial top view of the wheel's actuator.
Figure 3:
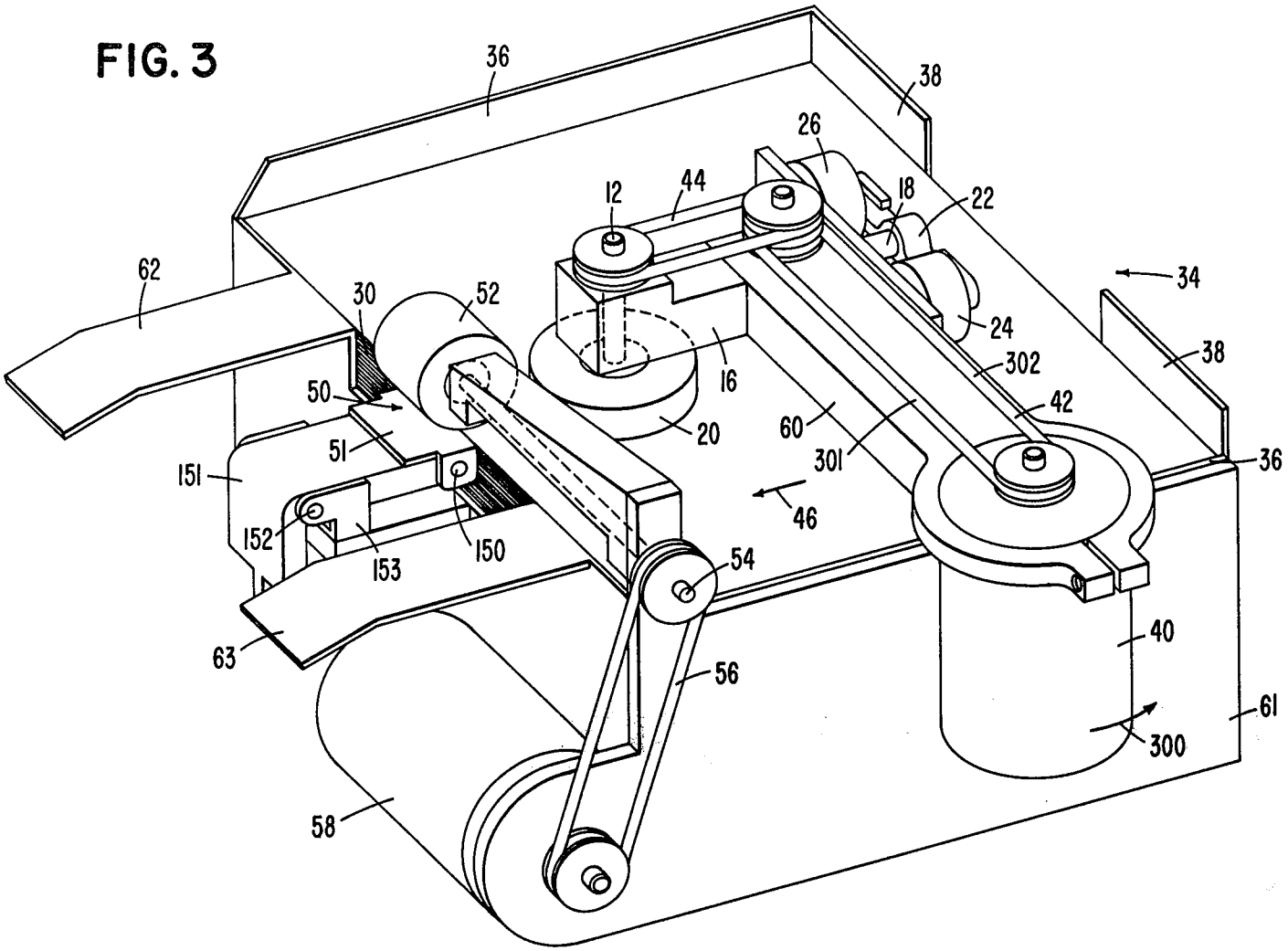
FIG. 3 shows a reverse buckle sheet feed station employing the tilt wheel sheet separator of the invention.

FIG. 1 shows the sheet separator means of the invention which comprises metal disk 10 rigidly attached to shaft 12 for rotation therewith. Shaft 12 is continuously clockwise driven by motor 40 (FIG. 3). Mounted about the periphery of disk 10 is a plurality of free rolling wheels or rollers 14. Rollers 14 are preferably formed of a metal or hard plastic. However, within the teachings of the present invention, resilient rubber rollers may be used. Shaft 12 is mounted to metal block 16 (FIG. 2). Fixedly attached to block 16 is metal rod 18. The entire assembly 12 and 18 is movable with rod 18 in order to tilt wheeled disk 10, to thereby bring rollers 14 into contact with a stack of paper 30 (FIG. 3) for feeding one sheet at a time therefrom. Protective metal or plastic cover 20 is provided to prevent unnecessary environmental contamination of the sheet separator means.

Figure 1A:
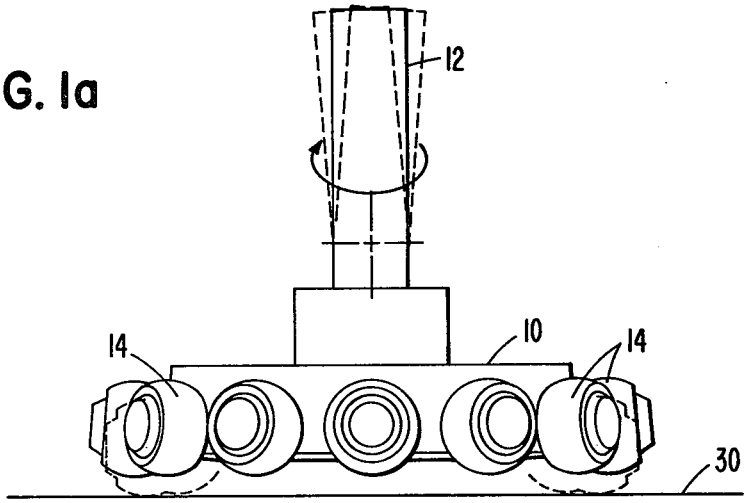
FIG. 1*a* is a side view of FIG. 1's wheel.

The sheet separator means, i.e. disk 10, rollers 14 and shaft 12, is capable of assuming at least two tilt positions as well as a neutral position generally parallel to the stack of sheets. As shown in FIG. 1*a*, in phantom, the free rollers here for illustrative purposes, are brought into contact with the stack of sheets 30 by tilting disk 10 by means of a tilting force applied to rod 18.

While the wave generator or combing wheel specifically disclosed herein is of the preferred substantially frictionless roller type, the present invention is not to be limited thereto. Generically, these rollers, which constitute a plurality of free rolling means, are more broadly a plurality of substantially frictionless sheet engaging means—i.e. sheets are shingled due to combing wheel action, rather than due to the action of friction. By way of example, rollers 14 may be replaced by stationary objects of similar shape, such objects being formed of hard, low friction material.

Refer now to FIG. 2, which shows preferred means for bringing the active elements, i.e. rollers 14 of the sheet separator, into contact with the sheets to be fed. Portions of the apparatus which are the same in both FIGS. 1 and 2 are given the same reference numerals. In FIG. 2, metal bar 22 is fixedly attached to rod 18. Rotary solenoids 24 and 26, operable in response to signals indicating specific conditions, are provided for moving bar 22 and thereby rod 18. Spring 28 is provided to aid in the restoration of the disk wheel sheet separator assembly to its neutral, that is, noncontacting position when neither of the rotary solenoids 24 and 26 is energized.

FIG. 3 illustrates a sheet separating and feed station of the invention. Parts of the apparatus already described are given the same reference numerals. The basic operation of a preferred embodiment of the invention will be described having reference to FIG. 3. The stack 30 of sheets to be fed is placed in a bin 34. In this illustrative embodiment, bin 34 has metal side walls 36 and 38 for aligning the short and long edges of the sheet in the stack 30 respectively. Motor 40 is provided for continuously rotating shaft 12 through rubber belt drive means 42 and 44. The apparatus is designed to feed sheets in a direction indicated by arrow 46 to feed nip 50. Feed nip 50 includes liftable front edge restraint 51 which is adapted to cooperate with feed roller 52. Roller 52 is mounted at a stationary position on rod 54 for continuous rotation by belt 56 and motor 58. Sheet guides 62 and 63 support a sheet as it is fed by roller 52.

Stack 30 is supported on an elevator of a conventional type, and stack height sensing means, not shown, operates an elevator motor to maintain the stack's top sheet at the vertical position shown in FIG. 3.

Motor 40, and extending metal arm 60, are fixed to metal side mounting plate 61, to which motor 58 is also mounted.

A circuit for controlling the operation of the various components of the system will be described hereinbelow. In response to appropriately developed signals, the sequence of operation is this: bar 22 is tilted in a counterclockwise direction (as viewed in FIG. 2) by the action of rotary solenoid 24. As a result, continuously rotating disk 10, with its associated free rollers 14 is brought into contact with the topmost sheet of stack 30. Force is transmitted in decreasing amounts from the top sheet to the underlying sheets. The topmost sheet has the greatest force imparted thereto and experiences the greatest amount of movement towards the rear of bin 30 and its rear edge stack aligner 38. Because rear edge stack aligner 38 is fixed in this embodiment, a buckle is formed in the topmost sheet. Solenoid 24 is energized for a given time period. Thereafter, solenoid 24 is deactivated and solenoid 26 is activated to tilt bar 22 in a clockwise direction. The opposite side of disk 10, with its associated rollers 14, is brought into contact with the uppermost sheet. It is to be noted that a force in the opposite direction to the buckle direction, i.e. toward feed nip 50, is now imparted in successively decreasing amounts to the topmost sheet and the underlying sheets in stack 30. The top sheet is thereby brought into proper position for engagement with feed nip 50, whereas the underlying sheets in the stack are restored to their original unshingled positions. In response to an appropriate signal developed as a result of the topmost sheet being transported to feed nip 50 (see photocell/light source couple 133, 134 of FIGS. 5 through 8), solenoid 26 is deactivated and wheel disk 10 returns to its neutral position, in preparation for the next feed cycle which may, of course, as is well understood in the art be timed in accordance with the desired feed rate to a sheet utilizing device, for example a copier, not shown.

While the means for pivoting disk 10 has been shown as comprising a pair of rotary solenoids 24 and 26 which cooperate with bar 22, the present invention is not to be limited thereto. By way of example, such a means may alternatively comprise opposed linear solenoids which selectively exert opposite directions of pull on an arm radially extending away from rod 18, wherein such a construction includes a resilient coupling operable to limit the force with which rollers 14 are presented to the paper. In yet another arrangement rotary solenoids, or a stepping motor, are directly coupled to rod 18.

In the arrangement of FIG. 3, rotary solenoid 24 (whose operation causes the right-hand portion of disk 10 to engage the paper) is energized for a given time period. This time period is selected to reliably form a sheet buckle, and to withdraw the leading edge of only the top sheet out from under restraint 51. When this time period has expired, solenoid 24 is deenergized, and solenoid 26 is energized. Energization of solenoid 26 continues until the leading edge of this top sheet is sensed within the nip formed by members 51, 52.

Figure 4:
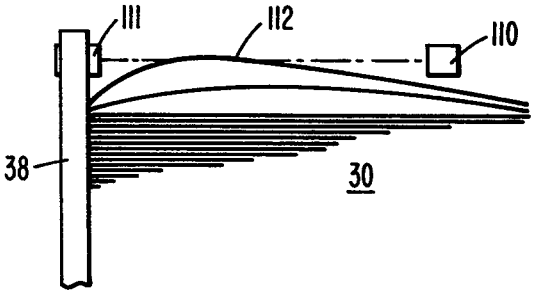
FIG. 4 shows a photocell/light source couple for sensing the buckle height achieved by the arrangement of FIG. 3.

FIG. 4 shows an equivalent arrangement wherein the energization of solenoid 24 continues until a photocell/light source couple 110, 111 has sensed the buckling of a top sheet 112.

FIGS. 5, 6, 7 and 8 depict, respectively: (1) the neutral position of stack 30 and disk 10; (2) the quasibuckled position of top sheet 130; (3) the feed-forward of top sheet 130 into nip 51, 52; and (4) the feed-forward of top sheet 13 by roller 52. FIGS. 5–8 can be implemented by the apparatus of FIG. 3 by removing wall 38.

Figure 6:
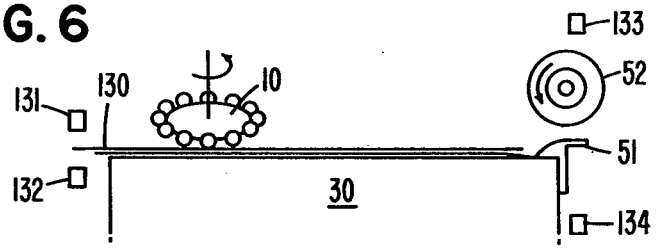
Figure 7:
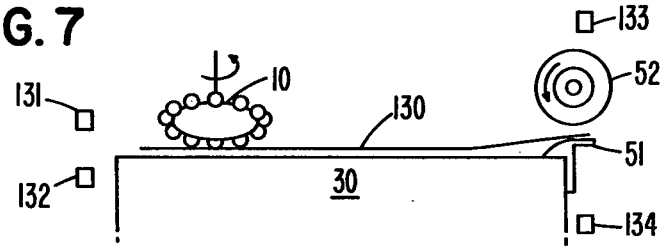
Figure 8:
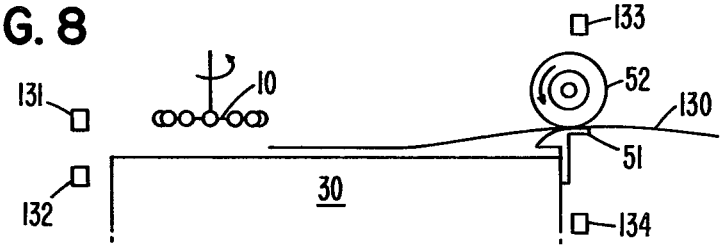

FIG. 6 depicts the equivalent of a buckle, wherein top sheet 130 is moved back to be sensed by light source/photocell couple 131, 132, whereupon the direction of tilt of disk 10 is changed, to effect the FIG. 6 to FIG. 7 transition.

FIGS. 5 through 8 also show the photocell/light source couple 133, 134 which operate to restore the wave generator disk to its neutral position when the top sheet's leading edge has been shingled up over restraint 51 into open nip 50, 51.

Figure 9:
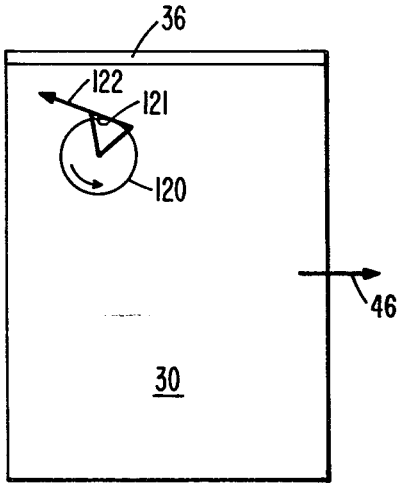
FIGS. 9 and 10 show a modified direction of wheel tilt which achieves sheet side edge alignment.
Figure 10:
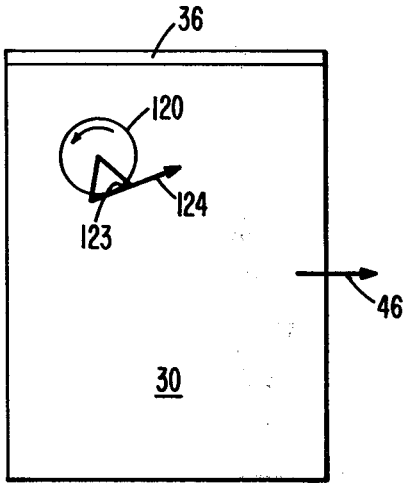

If desired, the angle of tilt of shaft 12 may be other than 180° opposed, as is achieved by the construction and arrangement of FIG. 3. This is diagrammatically shown in FIGS. 9 and 10 wherein the rotating disk is depicted as 120. In FIG. 9, arc 121 and vector 122 depict the arc of roller contact to paper stack 30, and the force vector applied to the top shingled sheets, respectively, during sheet buckling. A minor component of force vector 122 extends in the direction of side wall 36. In FIG. 10, arc 123 and force vector 124 depict similar parameters during forward feed of the top sheet into FIG. 3's feed nip 51, 52.

As can be seen, during both modes of operation of disk 120, minor component force vectors 122 and 124 are directed toward the bin's side wall 36. This minor force is not sufficient to buckle the sheet, but it is sufficient to maintain edge alignment to this wall 36.

An exemplary means of implementing such a tilting motion may, for example, include a cam surface cooperating with shaft 12, such that rotation of rod 18 causes shaft 12 to travel along this cam, so as to tilt in the generally opposite, but not 180° displaced, direction defined by arcs 121 and 123. Another means for implementing such a tilting motion is to permanently mount FIG. 3's motor such that its rotational axis is shifted in the direction of arrow 300, about an axis parallel to, but lower than, the two runs 301 and 302 of belt 42.

Figure 11:
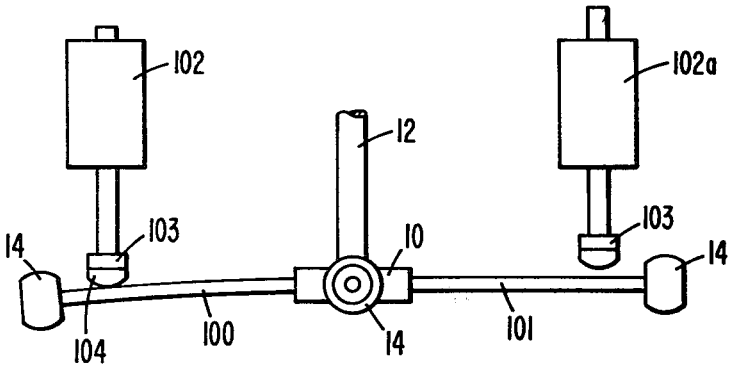
FIG. 11 shows an alternate construction of FIG. 1's tiltable wave generator wheel.

FIG. 11 discloses an alternative and equivalent means to that of FIG. 2, wherein the plurality of rollers 14 (only two of which are shown) are connected to rotating disk 10 by way of flexible metallic spokes 100 and 101. In FIG. 11, the equivalent of FIG. 2's rotary solenoids 24 and 26 are linear solenoids 102 and **102*a*. Solenoid 102*a* is shown deenergized. Solenoid 102 is shown energized. In the energized position, the solenoid is effective to push its guide shoe 103 down so as to intercept the advancing spoke, as the spoke rotates in the plane defined by disk 10 and spoke 101. The guide shoe deflects the spoke's roller down onto the paper stack, as the roller passes under the energized solenoid. For this purpose, guide shoes 103 include an arcuate bottom section 104**.

Figure 12:
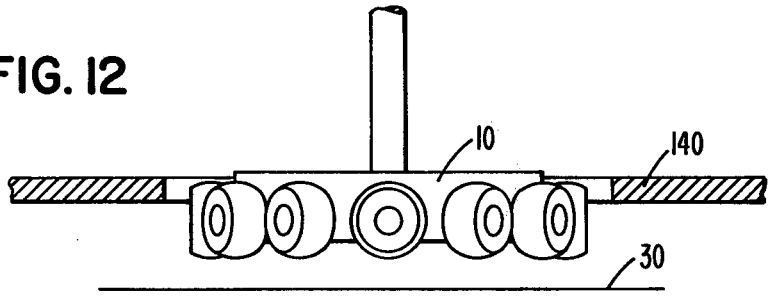
FIG. 12 discloses a cover plate which may be used with the disk of FIG. 1 or 11.

If desired, disc 10 may cooperate with a stationary, flat plastic or metal cover plate 140 (FIG. 12) which covers the major portion of stack 30. This cover plate reduces contamination from dust and the like, and additionally acts as an upper paper guide to minimize paper buckling or possible upward paper movement due to the spinning of disk 10 when the disk is in its neutral position.

Figure 13:
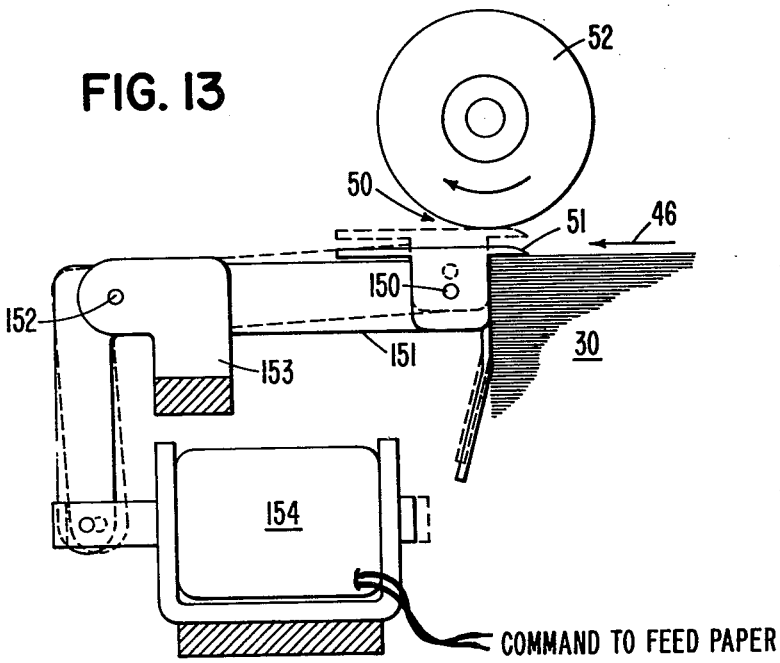
FIG. 13 is a detailed side view of a preferred drive nip used in the construction and arrangement of FIG. 3.

FIG. 13 shows the detail of FIG. 3's drive nip 50. This nip comprises fixed-position, and continuously rotating roller 52, and movable restraint 51. As shown the lower surface of restraint 51 holds down the front edge of stack 30, and its upper surface is contoured so as not to interfere with the edge of a sheet being fed in feed direction 46, into nip 50.

Restraint 51 is pivotally mounted, as at 150, to an L-shaped metal arm 151. Arm 151 is in turn pivoted at fixed position pivot 152, by way of metal bracket 153.

Fixed position solenoid 154, shown in its deenergized position, is operable, when energized, to move restraint 51 to its dotted line position, thus closing nip 50. A spring, not shown, maintains nip 50 open when solenoid 154 is deenergized.

Various modifications may be made without departing from the spirit of the invention. The principal advantages of this invention reside in the achievement of motion in two opposite directions, from a wheel continuously rotating in a single direction, by tilting the wheel in opposite directions into contact with the paper stack.

The advantages available from the invented apparatus has utility in the art of sheet feeding in general, but in particular where the reliability of single sheet feed is important.

The preferred embodiment, already described, including modifications, relates to what may be called a push-pull feed system where the stack is first driven away from feed nip 50, to withdraw the uppermost sheet from under forward sheet restraint 51, and then the stack is driven in the opposite direction to restore the second and succeeding sheets to their original position beneath restraint 51, as the topmost sheet is caught between restraint 51 and feed nip roller 52.

In any of the arrangements, the invention contemplates the addition of a sheet brake means to engage the second and subsequent sheets in the stack, as the top sheet is fed away by nip 50.

A control means, of a type which can be readily supplied by one skilled in the art, electrically provides control that causes the wave generator wheel disclosed herein to first tilt in a direction so as to withdraw the top sheet's front edge out from under front edge restraint 51. This can be accomplished in an open-loop fashion, as by using a timer, or in the closed-loop fashion of FIGS. 4 and 5–8. Once this has been accomplished, the wave generator wheel is generally oppositely tilted, to effect movement of the top sheet's front edge up over restraint 51, and into open nip 51–52, or perhaps a closed feed nip such as 51–52. In any event, once the top sheet's front edge is driven to a feed position, and sensed at that position as by the means of FIGS. 5–8 (and its underlying sheets have been restored to their original position under edge restraint 51), the wave generator wheel is restored to the neutral, untilted position. Thereafter, when this top sheet has been removed, the absence of a sheet at the feed position is sensed, and the above-described cycle repeats.

Figure 14:
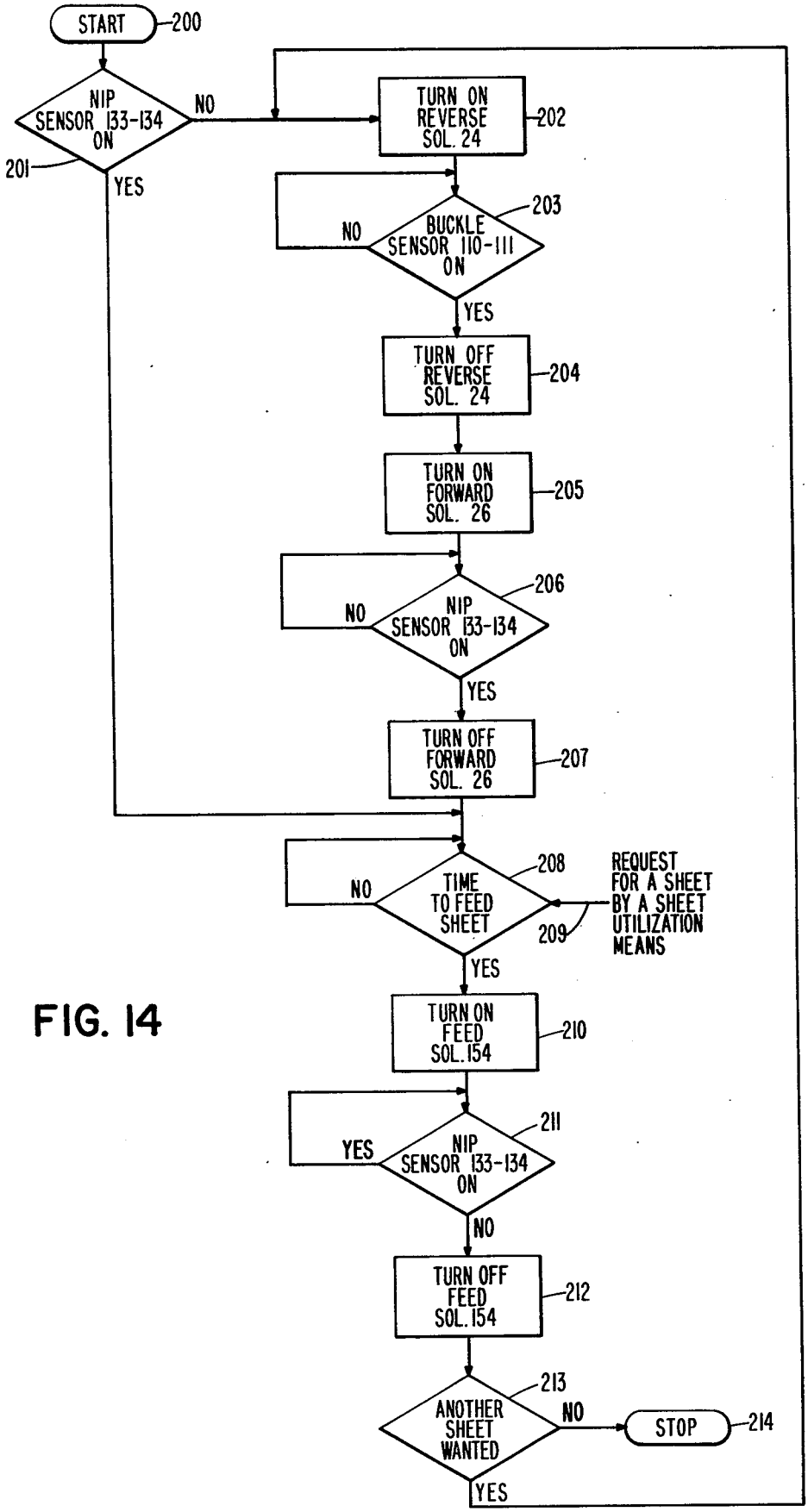
FIG. 14 is the control flow diagram of the electrical control means operable to control the arrangement of the present invention.

A readily understandable teaching to one skilled in the art is the control flow chart of FIG. 14.

Figure 5:
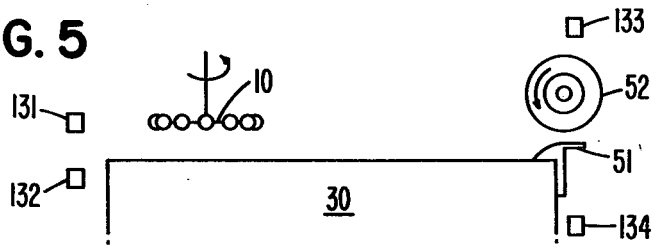
FIGS. 5 through 8 depict various steps in the buckle feed achieved by arrangements like FIG. 3.

Assume the apparatus is as shown in FIGS. 3 and 5, i.e. no sheet is in the open feed nip 51–52. A start actuator 200 enables a decision element 201 which interrogates FIGS. 5–8's nip sensor 133–134 to see if a sheet of paper is present in the nip. Since one is not, FIG. 3's reverse shingling solenoid 24 is energized by operation of FIG. 14's action element 202. As a result, wheel 10 tilts so as to implement reverse sheet shingling as shown in FIG. 6.

This operation continues until decision element 203 detects the formation of a buckle by way of FIG. 4's buckle sensor 110–111 (or, alternatively, by way of FIG. 6's sensor 131–132).

At this point in the description it will be pointed out that FIG. 14's control means could include a number of safety checks. For example, buckle sensor 110–111 should not be sensing a buckle coincident with nip sensor 133–134 sensing a sheet. If such a condition exists, operator intervention is requested by way of an alarm, light, or the like.

When sheets have been properly shingled to the rear, decision element activates action elements 204 and 205. As a result, solenoid 24 is deenergized, and solenoid 26 is energized.

Wheel 10 now pivots to implement the condition of FIG. 7. Thus, the stack's top sheet 130 has its leading edge positioned in open feed nip 51–52. At this position, this sheet is sensed by FIG. 14's decision element 206. The first portion of the feed cycle has now been completed, and solenoid 26 is deenergized by action element 207.

Note that had decision element 201 detected a sheet at nip 51–52 when start actuator 200 was initially actuated, the control means would have proceeded directly to decision element 208.

The apparatus now remains dormant in the FIG. 7 condition, awaiting a request for a sheet from a sheet utilization means, as indicated by a signal at 209. When such a time to feed a sheet is detected by element 208, action element 210 is enabled to energize FIG. 13's solenoid 154, thus providing the arrangement of FIG. 8.

As a result, sheet 130 is removed from nip sensor 133–134. Decision element 211 now enables action element 212, to thereby deenergize solenoid 154.

Decision element 213 is controlled by the need to continue feeding a sheet to provide the FIG. 7 condition of the apparatus. If no such need exists, a stop condition 214 results, i.e. the apparatus remains dormant in its FIG. 5 condition. If such a need continues to exist, element 213 enables element 202, and the cycle repeats.

As an alternative, the FIG. 7 position could be chosen as the dormant position by allowing decision element 211 to directly control both of the action elements 212 and 202 when the absence of a sheet in nip 51–52 is detected.

While the invention has been shown and described with reference to particular embodiments and modifications thereto, it will be understood by those skilled in the art that other changes in form and detail may be made without departing from the spirit and scope of the invention.

What is claimed is:

1. In a sheet feeder for feeding sheets, one at a time from a stack, to sheet feed means; improved sheet separator means comprising:

a disk rotatable in a plane generally parallel to the stack about an axis generally perpendicular to the stack;

a plurality of substantially frictionless sheet engaging means mounted about the periphery of said disk;

means for pivoting said disk in a first direction for bringing a portion of said sheet engaging means into contact with the topmost sheet of the stack whereby the stack is shingled away from said feed means; and for pivoting said disk in a second direction for bringing another portion of said sheet engaging means into contact with the topmost sheet of the stack whereby the stack is restored to its unshingled state; and means operable to separate the topmost sheet from the underlying sheets during said restoration.

2. The apparatus defined by claim 1 including means operable as a result of said separation to allow operation of sheet feed means on said topmost sheet.

3. The apparatus defined by claim 2 wherein said substantially frictionless sheet engaging means comprise free rolling means.

4. The apparatus defined by claim 3 wherein said sheet feeder is of the reverse buckle type including means blocking movement of at least the topmost sheet in said direction away from said feed means, so as to produce a sheet buckle, detecting means operable to detect a given size buckle, and means controlled by said detecting means and operable to institute movement of the topmost sheet toward said feed means.

5. The apparatus defined by claim 3 including a side sheet guide, and means operable to produce pivoting of said disk in said first and second directions so as to produce a minor sheet drive side alignment force against said side sheet guide.

6. The apparatus defined by claim 3 including means detecting movement of at least the topmost sheet in said direction away from said feed means, and means controlled by said detecting means and operable to institute movement of the topmost sheet toward said feed means.

7. Improved means for separating and feeding sheets one at a time from a stack in a stack holder including a front leading edge sheet retainer; comprising:

a wheel rotatable in one direction in a plane parallel to the stack;

a plurality of substantially frictionless sheet engaging means mounted about the circumference of said wheel;

means for tilting said wheel in a first direction for bringing said sheet engaging means on one side of the wheel into contact with the stack whereby the stack is shingled rearwardly; and for tilting said wheel in a second direction for bringing said sheet engaging means on another portion of said wheel into contact with the stack, whereby the stack is driven in the feed direction to restore the second and succeeding sheets in the stack to an unshingled state, but with the topmost sheet now above the leading edge retainer; and feed nip means positioned adjacent the leading edge retainer operable to feed the topmost sheet.

8. The apparatus of claim 7 including means for detecting when the topmost sheet is free of said retainer, and means connected to be controlled by said detecting means to effect said tilting in said second direction.

9. The apparatus of claim 8 wherein said sheet engaging means comprise free rolling means.

10. The apparatus of claim 7 wherein said means for detecting comprises a rear sheet stop, and means operable to detect a given size buckle formed in at least the topmost sheet.

11. The apparatus of claim 10 wherein said sheet engaging means comprises free rolling means.

12. The apparatus of claim 7 wherein said means for detecting comprises means operable to detect said rearward shingling.

13. The method of selectively imparting linear motion to the top sheets of a stack of sheets in two generally opposite directions by tilting a continuously rotating disk having frictionless sheet engaging means spaced about its periphery so as to selectively bring different portions of said sheet engaging means into contact with the top sheets of the stack, and withdrawing an edge of the stack's top sheet out from under an edge restraint by one direction of tilting.

14. The method of claim 13 including the step of feeding said edge of the top sheet to a sheet feed means by the generally opposite direction of tilting.

15. The method of claim 14 wherein the generally opposite direction of tilt produces a minor component of sheet motion force in a side-alignment direction.

16. The method of claim 14 including the step of forming a buckle in at least the top sheet as its said edge is withdrawn out from under said edge.

17. The method of claim 16 including the steps of detecting said buckle, and instituting said generally opposite direction of tilt as a result thereof.

18. The method of claim 17 wherein the generally opposite directions of tilt produce a non-buckling component of sheet motion force in a direction of a side sheet alignment surface.

19. The method of claim 14 including the steps of detecting movement of at least the top sheet as its said edge is withdrawn out from under said edge, and instituting said generally opposite direction of tilt as a result thereof.

* * * * *